US010532472B2

(12) United States Patent
Maras et al.

(10) Patent No.: US 10,532,472 B2
(45) Date of Patent: Jan. 14, 2020

(54) HOOK BLADE ACCESSORY TOOL FOR AN OSCILLATING TOOL

(75) Inventors: Verica Maras, Schaumburg, IL (US); Gavin Jerome, Park Ridge, IL (US); Brian Knoles, Springfield, IL (US); Jeremy Rubens, Palatine, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/343,046

(22) Filed: Jan. 4, 2012

(65) Prior Publication Data

US 2013/0167382 A1 Jul. 4, 2013

(51) Int. Cl.

| | |
|---|---|
| ***B26B 3/08*** | (2006.01) |
| ***B26B 5/00*** | (2006.01) |
| ***B26B 7/00*** | (2006.01) |
| ***B26B 9/02*** | (2006.01) |

(52) U.S. Cl.

CPC ..... *B26B 7/00* (2013.01); *B26B 3/08* (2013.01); *B26B 5/005* (2013.01); *B26B 9/02* (2013.01)

(58) Field of Classification Search

CPC .. B26B 3/08; B26B 5/005; B26B 7/00; B26B 9/00; B26B 9/021; B26B 9/02

USPC ..... 30/314, 353, 351, 317, 356, 315

See application file for complete search history.

(56) References Cited

U.S. PATENT DOCUMENTS

| | | | | |
|---|---|---|---|---|
| 334,724 | A * | 1/1886 | Ruekstuhl | 30/353 |
| 847,815 | A * | 3/1907 | Pigg | 30/295 |
| 2,007,700 | A * | 7/1935 | Ziminski | 30/314 |
| 4,339,878 | A * | 7/1982 | Tozzi | 30/298 |
| 4,543,720 | A | 10/1985 | Grunikiewicz et al. | |
| 4,989,320 | A * | 2/1991 | Borkott et al. | 30/272.1 |
| 5,456,011 | A | 10/1995 | Inkster | |

(Continued)

FOREIGN PATENT DOCUMENTS

| | | |
|---|---|---|
| EP | 0294617 A1 | 12/1988 |
| WO | 2011132134 A1 | 10/2011 |

OTHER PUBLICATIONS

Fein Sickle Saw Blade.pdf—Tool King website (thttp://www.toolking.com/fein-6-39-03-162-01-7-diamond-coated-sickle-saw-blade-for-supercut), Printed Mar. 11, 2011.

(Continued)

*Primary Examiner* — Clark F Dexter

(74) *Attorney, Agent, or Firm* — Maginot, Moore & Beck LLP

(57) ABSTRACT

An accessory tool for an oscillating power tool includes a mounting portion and a blade portion that extends from the mounting portion. The blade portion includes a first lateral edge portion, a second lateral edge portion, and a leading edge portion. A cutting edge is defined in the second lateral edge portion that includes a rearward facing portion that extends generally laterally from a distal end portion of the second lateral edge portion toward the first lateral edge portion and a forward facing cutting edge portion that extends from said second lateral edge portion toward said first lateral edge portion. The rearward facing cutting edge portion is at least partially interposed between the leading edge portion and the mounting portion, and the forward facing cutting edge portion is at least partially interposed between the rearward facing cutting edge portion and the mounting portion.

4 Claims, 4 Drawing Sheets

(56) References Cited

U.S. PATENT DOCUMENTS

| | | | | |
|---|---|---|---|---|
| 5,575,069 | A | 11/1996 | Roberto Kneeland | |
| 5,720,105 | A * | 2/1998 | Gates | 30/353 |
| D605,005 | S * | 12/2009 | Benson | D8/20 |
| 8,250,767 | B1 * | 8/2012 | Ciccarella et al. | 30/314 |
| 2005/0034312 | A1 * | 2/2005 | Ai | 30/353 |
| 2007/0283572 | A1 * | 12/2007 | Saiz | 30/272.1 |
| 2010/0095534 | A1 | 4/2010 | Saiz | |
| 2010/0223793 | A1 | 9/2010 | Hansen et al. | |
| 2012/0144676 | A1 | 6/2012 | Davidian et al. | |

OTHER PUBLICATIONS

Reid Manufacturing Company Pneumatic Blades.pdf—Reid Manufacturing Company website (http://www.reidmfg.com/pneumatic.php), printed Oct. 13, 2011.

Knives_Razor_blades_printout.pdf, compilation of images of hand-held knives and utility blades found on the internet, Document Dated Jun. 22, 2011.

International Search Report in corresponding PCT Application (i.e., PCT/US2013/020135) dated Mar. 15, 2013 (8 pages).

* cited by examiner

HOOK BLADE ACCESSORY TOOL FOR AN OSCILLATING TOOL

TECHNICAL FIELD

This invention relates to the field of oscillating power tools, and more particularly to accessory tools for use with oscillating power tools.

BACKGROUND

Oscillating power tools are lightweight, handheld tools configured to oscillate various accessory tools and attachments, such as cutting blades, sanding discs, grinding tools, and many others. Accessory tools enable an oscillating power tool to be used to perform a wide variety of tasks from cutting woods and metals to polishing and grinding stone and masonry. Each accessory tool, however, typically is configured to perform only certain types of tasks on certain types of materials.

For example, cutting accessory tools for an oscillating tool typically have a mounting portion that secures the accessory tool to an oscillating drive of the oscillating tool and a blade portion that extends generally forwardly from the mounting portion. The leading edge of the blade portion typically serves as the cutting edge for the accessory tool and is often serrated form cutting teeth. The dimensions and geometry of the blade portion and the cutting teeth are varied from accessory tool to accessory tool for cutting different kinds of materials and/or making different kinds of cuts.

Because the cutting edge is provided on the leading edge of the accessory tool, cutting operations are performed by "push cutting" in which the leading cutting edge is moved generally forwardly to engage the material to be cut. In some cases, however, there may not be enough room to position the cutting edge and/or maneuver the oscillating tool for push cutting. In addition, push cutting is effective for cutting materials that are hard enough to withstand the applied force without flexing or buckling, such as most woods and metals. Push cutting, however, is difficult to perform in flexible materials, such as carpet, plastic, cardboard, asphalt shingles, and the like, because they can flex and buckle in response to an applied force. Flexible materials, such as these, must typically be held taut while they are being cut which is difficult to do while push cutting.

In addition, a serrated cutting edge performs cuts generally by ripping the cutting teeth through the material that is being cut which allows cuts to be performed in harder materials, such as woods and metals, without requiring much force. A serrated cutting edge, however, is generally ineffective for performing cuts in flexible, soft, and/or easily breakable materials, such as carpet, plastic, cardboard, asphalt shingles, vinyl tile, drywall, and the like, because ripping the cutting teeth through these materials can result in frayed edges, shredding, and breaking.

What is needed is a cutting accessory tool for an oscillating power tool, that has a cutting edge that enables precise, controlled cuts to be performed in materials, such as carpet, plastic, cardboard, asphalt shingles, vinyl tile, drywall, and the like, and that enables these cuts to be performed by pulling the cutting edge of the accessory tool through the material that is being cut.

SUMMARY

In accordance with one embodiment, an accessory tool for an oscillating power tool includes a mounting portion configured to mate with an oscillating drive member of a power tool, and a blade portion that extends from the mounting portion. The blade portion includes a first lateral edge portion, a second lateral edge portion, and a leading edge portion. A cutting edge is defined in the second lateral edge portion that includes a rearward facing portion that extends generally laterally from a distal end portion of the second lateral edge portion toward the first lateral edge portion and a forward facing cutting edge portion that extends from said second lateral edge portion toward said first lateral edge portion. The rearward facing cutting edge portion is at least partially interposed between the leading edge portion and the mounting portion, and the forward facing cutting edge portion is at least partially interposed between the rearward facing cutting edge portion and the mounting portion.

DESCRIPTION

Figure 1:
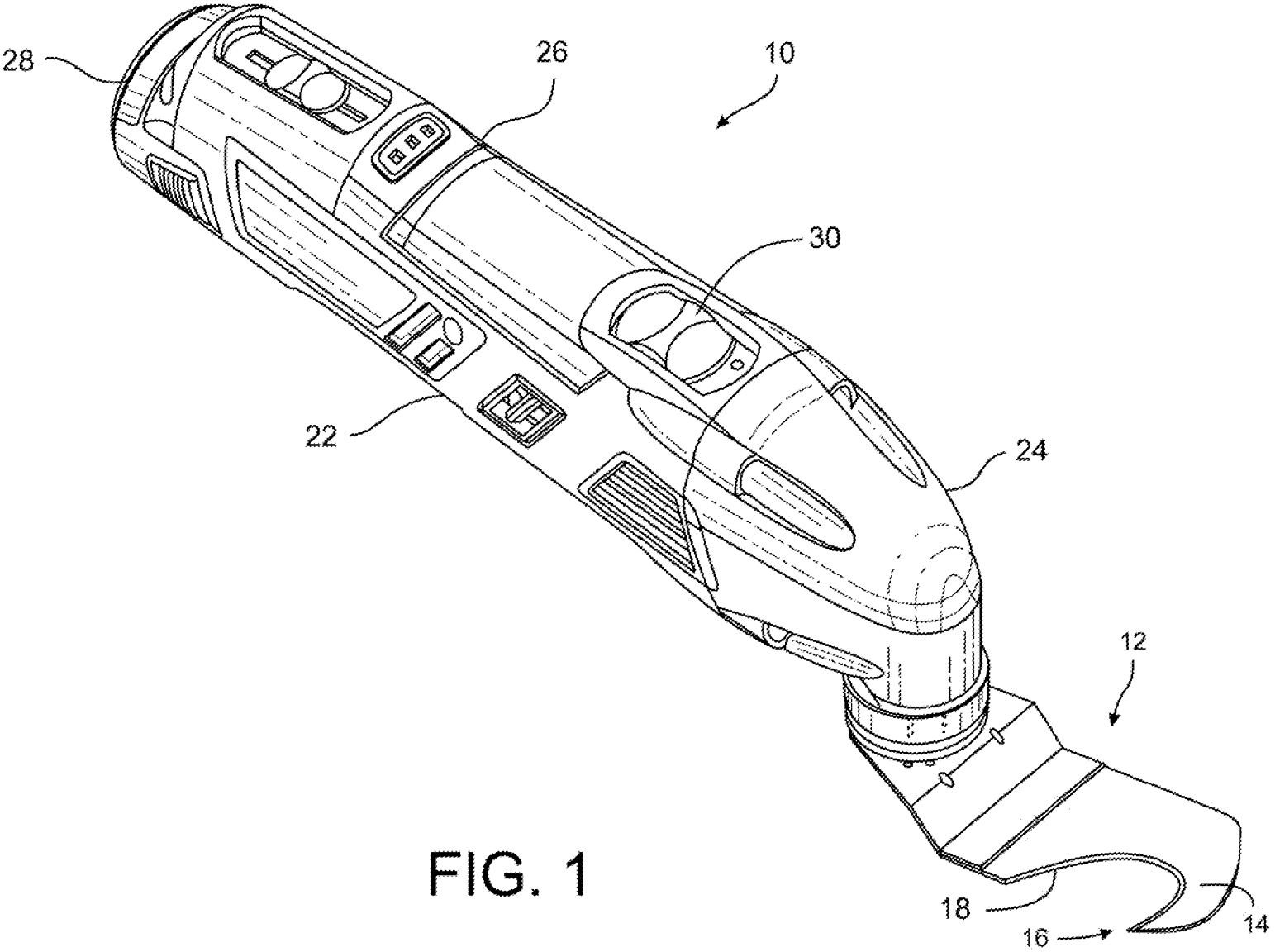
FIG. 1 is a perspective view of an oscillating tool including a hook blade accessory tool according to one embodiment the present disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Referring to FIG. 1, the present disclosure is directed to a hook blade accessory tool 12 for an oscillating power tool 10. As discussed below, the hook blade accessory tool 12 includes at least one hook-shaped blade 14 with a pointed tip portion 16 and a razor sharp cutting edge 18 that enables the accessory tool 12 to be used to penetrate and make precise, controlled cuts in materials, such as carpet, plastic, cardboard, asphalt shingles, vinyl tile, drywall, and the like.

The oscillating tool 10 for driving the hook blade accessory 12 includes a generally cylindrically shaped housing 22 constructed of a rigid material such as plastic, metal, or composite materials such as a fiber reinforced polymer. The housing 22 includes a nose portion 24 and a handle portion 26. The handle portion 26 encloses a motor (not shown). In one embodiment, the motor comprises an electric motor configured to receive power from a rechargeable battery 28 connected at the base of the handle portion 26. In other embodiments, electric power for the motor may be received from an AC outlet via a power cord (not shown). As an alternative to electric power, the oscillating power tool 10 may be pneumatically or hydraulically powered. Power to the motor is controlled by a power switch 30 provided on the handle portion 26 of the housing 22.

Figure 2:
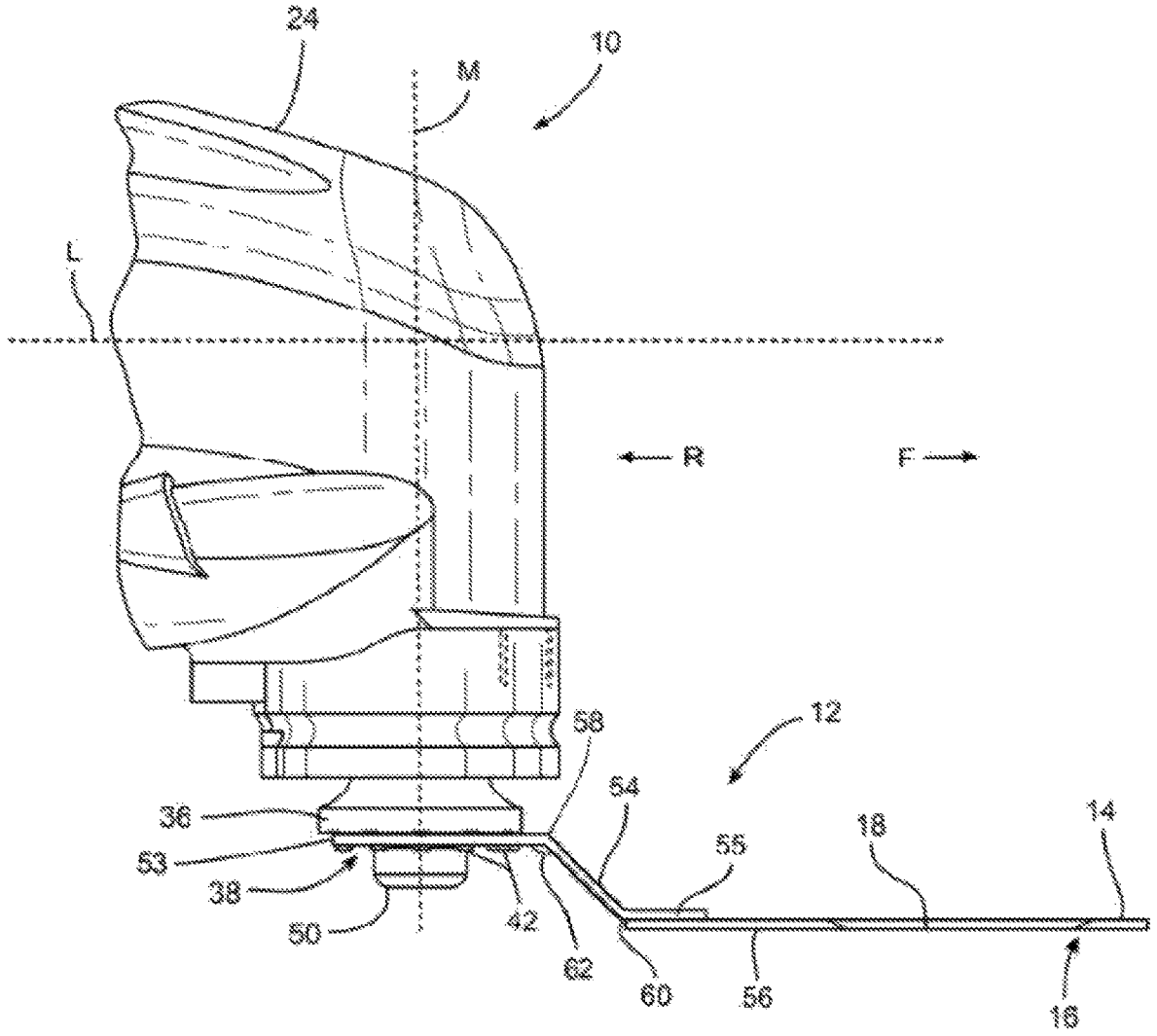
FIG. 2 is a partial view of the oscillating tool and hook blade accessory tool of FIG. 1 showing the nose portion of the oscillating tool.

Referring to FIG. 2, the oscillating tool 10 defines a longitudinal axis L. An oscillating drive member (not shown) extends generally perpendicularly with respect to the longitudinal axis L. The motor is configured to oscillate the drive member about an axis M at high frequencies, e.g., 5,000 to 25,000 oscillations per minute, with a small oscillating angle, typically in a range of between 0.5° and 7°. The drive member supports an accessory tool holder 36 exterior to the housing 24. The tool holder 36 is configured to releasably secure various accessory tools to the drive member, such as the hook blade accessory tool 12. As the tool holder 36 is oscillated by the drive member (not shown), the accessory tool 12 is driven to oscillate about the axis M.

To enable a secure connection between the tool holder 36 of the power tool 10 and accessory tools for use with the power tool, the tool holder 36 and associated accessory tools are provided with complementary drive structures 38, 40 (FIGS. 2 and 3) that mate to secure the accessory tool to the tool holder. In the embodiments described herein, the tool holder 36 includes the tool drive structure 38 that comprises a plurality of protrusions 42 arranged in a circular pattern about a central bore (not shown).

Figure 3:
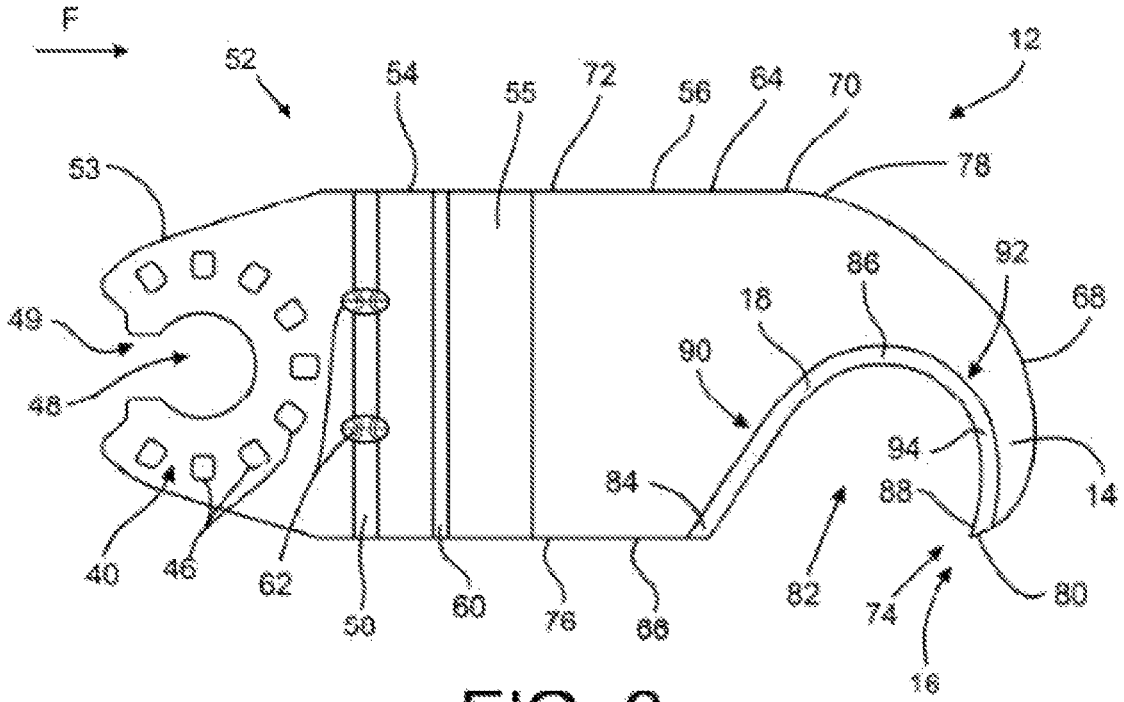
FIG. 3 is a top elevational view of the hook blade accessory tool of FIG. 1.

Accessory tools for use with the power tool 10, such as the hook blade accessory tool 12, includes the accessory drive structure 40 (FIG. 3) that is configured to mate or interlock with the tool drive structure 38 of the tool holder 36. As depicted in FIG. 3, the accessory drive structure 40 of the accessory tool 12 includes a plurality of openings or recesses 46 and a central opening 48 that are sized, shaped, and positioned complementary to the protrusions 42 and central bore, respectively, of the tool drive structure 38. When the accessory tool 12 is placed onto the tool holder 36, the protruding features 42 of the tool drive structure 38 are received in the corresponding openings and/or recesses 46 defined in the accessory drive structure 40.

A clamping member 50 (FIG. 2), such as a clamping screw, is used to press the accessory drive structure 40 of the accessory tool 12 into interlocking engagement with the tool drive structure 38 thus securing the accessory tool 12 to the tool holder 36. The interlocked drive structures 38, 40 enable the oscillating movement of the tool holder 36 to be imparted to the accessory tool 12. As depicted in FIG. 3, a mounting portion 52 defines a slot 49 that extends from the central opening 48 through the outer periphery of the mounting portion 52. The slot 49 enables the mounting portion 52 to be installed and removed from the tool holder 36 without having to completely remove the clamping screw 50.

Referring to FIG. 3, the hook blade accessory tool 12 comprises a generally planar body including the mounting portion 52 and a blade portion 56. The planar body is formed by stamping and bending one or more metal plates to form the body into a shape, the one or more metal plates made of hard metal materials, such as carbon and alloy steel or stainless steel. In the embodiment of FIGS. 1-3, the accessory tool 12 has a two-piece configuration in which the mounting portion 52 is formed from a first plate and the blade portion 56 is provided as a second plate that is secured to the first plate. Alternatively, the accessory tool 12 may be provided with a one-piece construction in which the mounting portion 52 and blade portion 56 are integrally formed by stamping and bending a single metal plate.

The mounting portion 52 has a generally flat disc-like shaped drive mount portion 53 that defines the central opening 48, the slot 49, and surrounding openings 46 of the accessory drive structure 40. The drive mount portion 53 is secured to the tool holder 36 with the mounting portion 52 and blade portion 56 arranged substantially perpendicular to the axis M of the drive member as depicted in FIG. 2. The mounting portion 52 thus oscillates substantially in a first plane, or oscillation plane, that is perpendicular to the axis M of the drive member.

The mounting portion 52 includes an interface portion 54 that is interposed between the blade portion 56 and the drive mount portion 53. The interface portion 54 extends generally forwardly and downwardly from the drive mount portion 53 to the blade portion 56 in order to offset the blade portion 56 from the drive mount portion 53 and provide clearance for the tool holder 36 and clamping screw 50 (FIG. 2) during use. The interface portion 54 includes a first angled, or bent, portion 58 located between the drive mount portion 53 and interface portion 54, and a second angled, or bent, portion 60 that is located proximate the blade portion 56. In the embodiment of FIGS. 1-3, the interface portion 54 includes a blade mounting portion 55 to which the blade portion 56 of the accessory tool 12 is secured. In embodiments in which the blade portion 56 and mounting portion 52 are integrally formed from a single metal plate, the interface portion 54 transitions into the blade portion 56 at the second bent portion 60.

As depicted in FIG. 3, the first bent portion 58 includes gussets 62 for strengthening the bends against further bending. In one embodiment, the gussets comprise ribs formed by pressing the bends from the outside to form protrusions in the inside corners of the first bend 58 (FIG. 2). In alternative embodiments, gussets may provided in the second bent portion 60 of the interface portion 54 in addition to or as an alternative to the gussets 62 in the first bent portion 58.

The blade portion 56 of the accessory tool 12 comprises a planar beam that extends from the interface portion 54 in the forward direction F generally parallel to the oscillation plane defined by the drive mount portion 53 of the mounting portion 52. The blade portion 56 includes a first lateral edge portion 64, a second lateral edge portion 66, and a leading edge portion 68. The first lateral edge portion 64 and the second lateral edge portion 66 are arranged generally parallel to each other on opposing sides of the blade portion 56. The lateral edge portions 64, 66 each include a distal end portion 70, 74 and a proximal end portion 72, 76. The leading edge portion 68 extends between the distal end portions 70, 74 of the lateral edges 64, 66. As depicted in FIG. 3, the leading edge portion 68 includes a first lateral end portion 78 that meets the distal end portion 70 of the first lateral edge 64 and a second lateral end portion 80 that meets the distal portion 74 of the second lateral edge 66.

Figure 4:
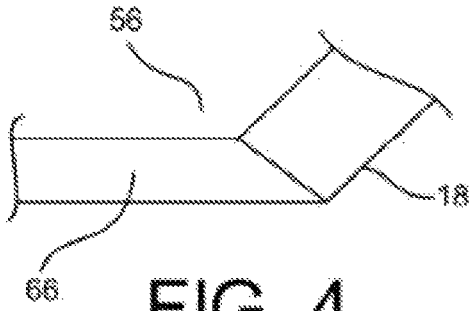
FIG. 4 shows an embodiment of the cutting edge of the hook blade accessory tool of FIG. 1 having a single bevel.

The accessory tool 12 includes a concave cutting edge 18 defined in the second lateral edge portion 66. The cutting edge 18 defines a convex-shaped cutout region 82 that is at least partially interposed between the leading edge portion 68 and the mounting portion 52 of the accessory tool 12. The concave cutting edge 18 is a razor sharp cutting edge which enables the accessory tool 12 to be used to make precise, controlled cuts in materials, such as carpet, plastic, cardboard, shingles, vinyl tile, drywall, and the like. The razor sharp edge may be formed by grinding or laser cutting the concave edge portion 18 to form a beveled edge. The razor sharp cutting edge 18 may be defined by a single bevel (FIG. 4) formed by beveling one side of the blade portion 56, or a double bevel (FIG. 5) formed by beveling both sides of the blade portion 56. The size and shape of the cutout region 82 determines the configuration of the cutting edge 18. In the embodiment of FIG. 3, the cutout region 82 extends substantially half way across the width of the blade portion toward the first lateral edge 64. The cutout region 82 forms a gap in the second lateral edge portion 66 that extends from the distal portion 74 of the second lateral edge to an intermediate portion of the of the second lateral edge 66. The extent of the cutout region 82 toward the first lateral edge portion 64 and along the second lateral edge portion 66 can be varied to tailor the cutting edge 18 to suit particular tasks or material types.

The concave cutting edge 18 includes a rearward end portion 84, an innermost portion 86, and a forward end portion 88. The rearward end portion 84 meets the second lateral edge portion 66 proximate the proximal portion 76 of the edge 66, and the forward end portion 88 meets the distal portion 74 of the edge 66. The innermost portion 86 corresponds to the portion of the cutting edge 18 that is positioned the farthest toward the left lateral edge portion 64. As depicted in FIG. 3, the concave cutting edge 18 includes a forward facing cutting edge portion 90 that extends between the rearward end portion 84 and the innermost portion 86, and a rearward facing cutting edge portion 92 that extends between the innermost portion 86 and the distal end portion 74 of the second lateral edge 66.

The forward facing cutting edge portion 90 extends laterally from an intermediate portion of the second lateral edge portion 66 toward the first lateral edge portion 64. The rearward facing cutting edge portion 92 also extends generally laterally from the distal end portion 74 of the second lateral edge 66 generally toward the first lateral edge portion to be interposed between the leading edge portion 68 and the mounting portion 52. This configuration enables the rearward facing cutting edge portion 92 to be used by pulling the accessory tool 12 rearwardly to bring the rearward facing cutting edge 92 into engagement with a surface to be cut.

As depicted in FIG. 3, the rearward facing cutting edge portion 92 extends slightly rearwardly at it approaches the distal end portion 74 of the second lateral edge 66 and the lateral end portion 80 of the leading edge. As a result, a segment or portion 94 of the rearward facing cutting edge portion 92 is located forward of the forward end portion 88 of the cutting edge 18 relative to the direction F. This configuration results in the rearward facing cutting edge portion 92 having a hooked shape that facilitates "pull" cutting. Pull cutting is performed by hooking the forward end portion 88 of the rearward facing cutting edge portion 92 over an edge of a workpiece to be cut and pulling the oscillating tool 10 rearwardly so the cutting edge 92 engages the workpiece. In addition, when the accessory tool 12 is oscillated by oscillating tool 10, the razor sharp cutting edge 18 can perform precise, controlled cuts that are straight as well as curved in materials, such as carpet, plastic, cardboard, asphalt shingles, vinyl tile, drywall, and the like.

The leading edge portion 68 of the blade portion 56 has a generally convex-shape that extends between and encompasses the first lateral end portion 78 and the second lateral end portion 80 of the leading edge portion 68. In the embodiment of FIGS. 1-3, the leading edge portion 68 extends rearwardly as it approaches the distal end portions 70, 74 of the lateral edges 64, 66. The convex-shaped leading edge portion 68 follows the concave shape of the rearward facing cutting edge portion 92 to define the hook shape of blade portion 14. The second lateral end portion 80 of the leading edge portion 68 and the forward end portion 88 of the concave cutting edge 18 meet at the distal end portion 74 of the second lateral edge 66 to define the pointed tip portion 16. The pointed tip portion 16 enables the accessory tool 12 to be used to penetrate certain materials, such as drywall, carpet, cardboard, and the like, in order to start a cut. The tip portion 16 of the blade is oriented generally laterally so the tip portion 16 can penetrate the surface of a workpiece or material by moving the oscillating tool generally laterally.

Figure 6:
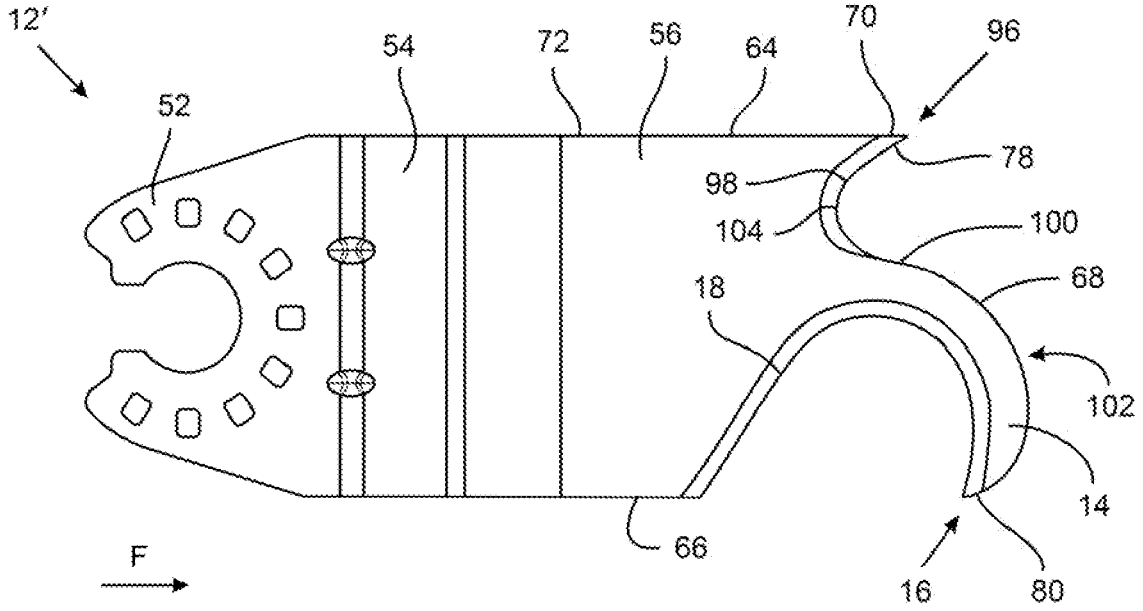
FIG. 6 is a top elevational view of an alternative embodiment of a hook blade accessory tool for use with the oscillating tool of FIG. 1.

In the embodiment of FIGS. 1-3, the blade portion 56 of the hook blade accessory tool 12 includes a single cutting edge 18 that is configured to cut materials by pull cutting. FIG. 6 depicts an alternative embodiment of a hook blade accessory tool 12'. In the embodiment of FIG. 6, the accessory tool 12' has substantially the same configuration as the accessory tool 12 of FIGS. 1-3 except that a second pointed tip 96 and a second razor sharp cutting edge 98 are provided in the leading edge portion 68 of the blade portion 56 proximate the first lateral end portion 78 of the leading edge 68. The second tip portion 96 and second cutting edge 98 are oriented generally in the forward direction F to enable the penetration and cutting of materials by push cutting, i.e., moving the oscillating tool 10 forwardly to bring the tip and/or cutting edge into engagement with a surface to be cut.

Figure 5:
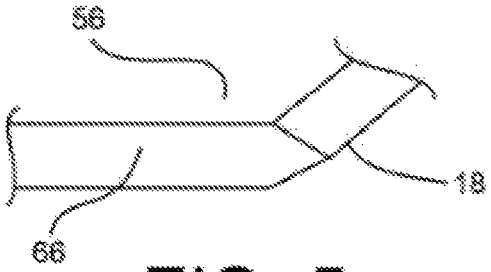
FIG. 5 shows an embodiment of the cutting edge of the hook blade accessory tool of FIG. 1 having a double bevel.

As depicted in FIG. 6, the leading edge 68 includes a concave-shaped portion 98 and a convex-shaped portion 102. The concave-shaped cutting edge portion 98 extends from the first lateral end portion 78 of the leading edge 68 to a transition portion 100 of the leading edge 68. The transition portion 100 corresponds to the area of the leading edge 68 that defines the transition from a concave shape to a convex shape. The second concave cutting edge 98 encompasses the first lateral end portion 78 of the leading edge and extends generally rearwardly from the first lateral end portion 78 to the rearmost portion 104 of the cutting edge 98, i.e., the portion of the cutting edge 98 located closest to the mounting portion 52 of the accessory tool 12'. The second concave cutting edge 98 also extends generally rearwardly from the transition portion 100 of the leading edge 68 to the rearmost portion 104 of the second concave cutting edge 98. Similar to the first concave cutting edge 18, the second concave cutting edge 98 comprises a razor sharp cutting edge that may be defined by a single bevel (FIG. 4) or a double bevel (FIG. 5).

In the embodiment of FIG. 6, the first lateral end portion 78 of the leading edge 68 meets the distal portion 70 of the first lateral edge portion 64 to define a second pointed tip portion 96. The second pointed tip portion 96 and the second concave cutting edge 98 are each oriented generally forwardly so the second tip portion 96 can penetrate and the cutting edge 98 can cut materials and surfaces by moving the accessory tool 12' in the forward direction F.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An accessory tool for an oscillating power tool, the accessory tool comprising:

a body having:

a drive mount portion located at one end of said body and configured to mate with an oscillating drive member of a power tool, the drive mount portion residing primarily in a first plane;

an interface portion integrally formed with the drive mount portion, the interface portion extending generally forwardly from the drive mount portion and including a blade mounting portion, the interface portion being angled with respect to the drive mount portion such that the blade mounting portion is offset from the first plane; and a blade portion permanently attached to the interface portion, the blade portion extending forwardly from the blade mounting portion, said blade portion including a first lateral edge portion, a second lateral edge portion, and a leading edge portion, said first and said second lateral edge portions each extending generally forwardly from said blade mounting portion, said leading edge portion extending generally laterally between a distal end portion of first lateral edge portion and a distal end portion of said second lateral edge portion, the blade portion including a cutting edge portion defined in said second lateral edge portion, said cutting edge portion including:

i) a rearward facing portion that extends generally laterally from said distal end portion of said second lateral edge portion toward said first lateral edge portion to a recessed position that is located substantially half way across a width of the blade portion between said first lateral edge portion and said second lateral edge portion, and ii) a forward facing portion that extends generally laterally from an intermediate portion of said second lateral edge portion to said recessed position to meet said rearward facing portion, wherein said leading edge portion includes a convex-shaped portion and a concave-shaped portion, the convex-shaped portion and the concave-shaped portion meeting at a transition portion, wherein said convex-shaped portion and said rearward facing portion of said cutting edge portion together define a hook, wherein said convex-shaped portion meets said rearward facing portion to define a first pointed tip portion for the hook, wherein said concave-shaped portion meets said distal end portion of said first lateral edge portion to define a second pointed tip portion, wherein the convex-shaped portion of the leading edge portion is located forwardly of the second pointed tip portion, wherein said concave-shaped portion includes a cutting edge portion, wherein said rearward facing portion is at least partially interposed between said leading edge portion and said mounting portion, wherein said forward facing cutting edge portion is at least partially interposed between said rearward facing portion and said mounting portion, and wherein said rearward facing portion of said cutting edge portion and said convex-shaped portion of said leading edge portion are generally uniformly spaced apart from each other from the transition portion to a forwardmost portion of said convex-shaped portion such that the hook has a generally uniform width from the transition portion to the forwardmost portion.

2. The accessory tool of claim 1, wherein:

said rearward facing cutting edge portion has a generally concave shape.

3. The accessory tool of claim 1, wherein:

said first pointed tip portion is oriented generally laterally; and said second pointed tip portion is oriented generally forwardly.

4. The accessory tool of claim 1, wherein:

said cutting edge portion of said second lateral edge portion and said cutting edge portion of said concave-shaped portion of said leading edge portion each comprise a razor sharp cutting edge.

* * * * *